US009365465B2

(12) United States Patent
Nielson et al.

(10) Patent No.: US 9,365,465 B2
(45) Date of Patent: Jun. 14, 2016

(54) ILLUMINATION COMPOSITIONS, ILLUMINATION FLARES INCLUDING THE ILLUMINATION COMPOSITIONS, AND RELATED METHODS

(71) Applicant: Orbital ATK, Inc., Dulles, VA (US)

(72) Inventors: Daniel B. Nielson, Tremonton, UT (US); Royce C. Duke, Thatcher, UT (US); Curtis W. Fielding, Hyrum, UT (US)

(73) Assignee: Orbital ATK, Inc., Plymouth, MN (US)

( * ) Notice: Subject to any disclaimer, the term of this patent is extended or adjusted under 35 U.S.C. 154(b) by 39 days.

(21) Appl. No.: 14/218,547

(22) Filed: Mar. 18, 2014

(65) Prior Publication Data

US 2015/0266792 A1 Sep. 24, 2015

(51) Int. Cl.

| | |
|---|---|
| ***C06B 45/00*** | (2006.01) |
| ***C06B 45/02*** | (2006.01) |
| ***C06B 31/00*** | (2006.01) |
| ***C06B 31/02*** | (2006.01) |
| ***D03D 23/00*** | (2006.01) |
| ***D03D 43/00*** | (2006.01) |
| ***C06B 23/00*** | (2006.01) |
| ***F42B 4/28*** | (2006.01) |
| ***C06B 33/00*** | (2006.01) |
| ***C06C 15/00*** | (2006.01) |

(52) U.S. Cl.

CPC ..... *C06B 45/02* (2013.01); *C06B 23/007* (2013.01); *C06B 31/02* (2013.01); *C06B 33/00* (2013.01); *C06C 15/00* (2013.01); *F42B 4/28* (2013.01)

(58) Field of Classification Search

USPC ..... 149/21, 2, 45, 61, 109.4, 109.6

See application file for complete search history.

(56) References Cited

U.S. PATENT DOCUMENTS

| | | | | |
|---|---|---|---|---|
| 3,024,143 | A * | 3/1962 | Sammons | C06B 23/00 149/18 |
| 3,733,223 | A | 5/1973 | Lohkamp | |
| 5,056,435 | A * | 10/1991 | Jones | C06B 21/0041 102/336 |
| 5,587,552 | A * | 12/1996 | Dillehay | C06C 15/00 102/336 |
| 5,912,430 | A | 6/1999 | Nielson | |
| 6,190,475 | B1 | 2/2001 | Nielson | |
| 6,230,628 | B1 | 5/2001 | Farnell et al. | |
| 6,277,296 | B1 * | 8/2001 | Scheffee | A62D 1/06 149/109.2 |
| 7,726,243 | B2 | 6/2010 | Richards et al. | |
| 2004/0011235 | A1 * | 1/2004 | Callaway | F41J 2/02 102/336 |

* cited by examiner

*Primary Examiner* — James McDonough
(74) *Attorney, Agent, or Firm* — TraskBritt

(57) ABSTRACT

An illumination composition comprising at least one oxidizer, at least one of a fuel and a binder, and at least one combustion rate modifier. The at least one oxidizer is selected from the group consisting of a potassium-containing oxidizer and a rubidium-containing oxidizer, the at least one oxidizer present in the illumination composition at from about 50 wt % to about 70 wt % and comprising particles each independently having a size within a range of from about 25 μm to about 325 μm. Additional illumination compositions, illumination flares, and methods of illuminating a target are also disclosed.

24 Claims, 1 Drawing Sheet

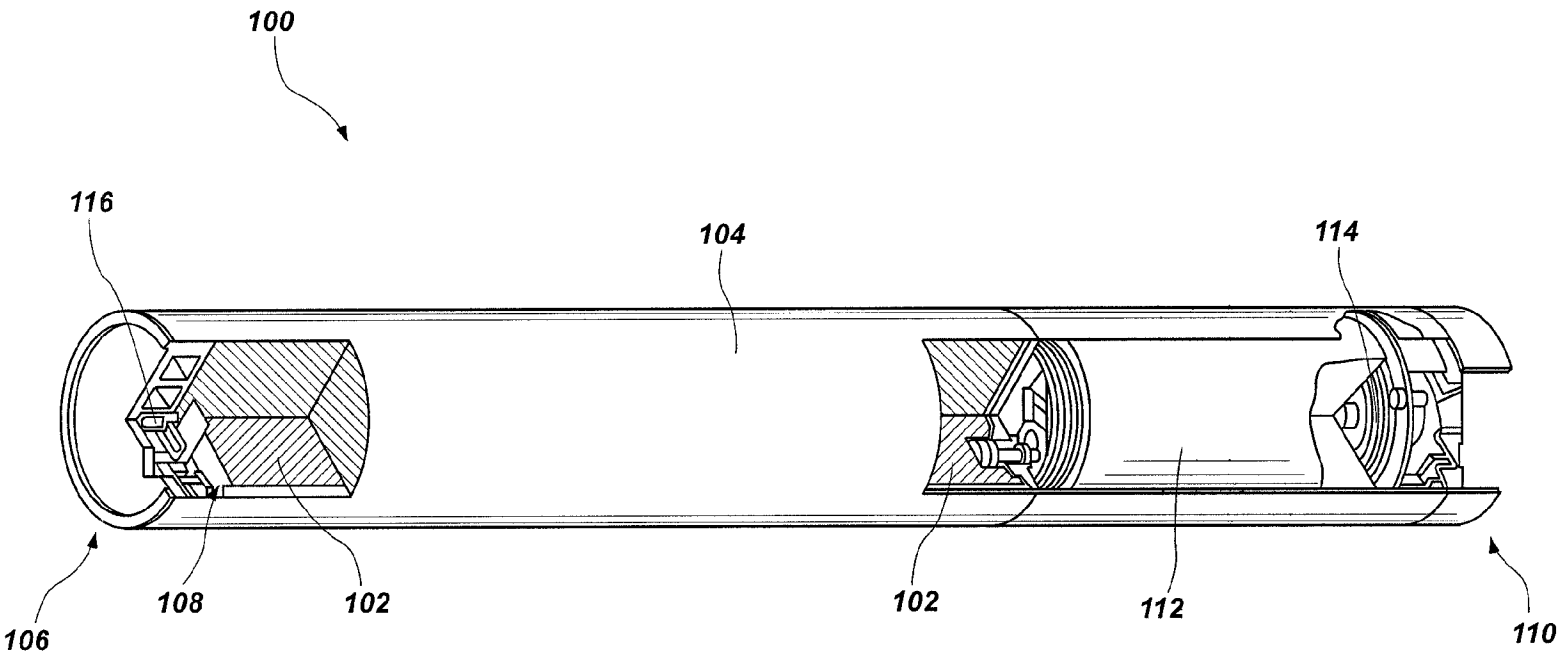
100
116
104
114
102
102
108
112
106
110

ILLUMINATION COMPOSITIONS, ILLUMINATION FLARES INCLUDING THE ILLUMINATION COMPOSITIONS, AND RELATED METHODS

TECHNICAL FIELD

The disclosure relates generally to compositions suitable for use in flares, and to methods of using the compositions. More specifically, the disclosure relates to illumination compositions formulated to generate a near-infrared (NIR) radiation during the combustion thereof, to related illumination flares and methods of illuminating a target.

BACKGROUND

Flares are pyrotechnic devices designed and configured to emit intense electromagnetic radiation at wavelengths in the visible region (i.e., light), the infrared (IR) region (i.e., heat), or both, of the electromagnetic radiation spectrum without exploding or producing an explosion. Conventionally, flares have been used for signaling, illumination, and defensive countermeasure in civilian and military applications. In such applications, illumination flares are typically launched above ground or water areas where enemy personnel and/or vehicles are suspected to be present. The illumination provided by the illumination flare facilitates visual detection of the enemy personnel and/or vehicles, providing more precise identification of target locations at which to aim ordnance. The illuminating effect provided by the illumination flare is conventionally enhanced by equipping the flare with a parachute, which increases the flight time by slowing the rate of descent of the illumination flare. The deployment of the parachute can also provide a force for activating an igniter contained within the casing of the illumination flare.

One common type of illumination flare is a NIR illumination flare. As used herein, the term "NIR illumination flare" means and includes a flare having a primary NIR (i.e., radiation at a wavelength of from 0.700 micrometers to 0.900 micrometers) output facilitating the illumination of a target (e.g., a battlefield) such that the target can be seen with a device (e.g., a NIR vision device, such as NIR-sensitive night vision goggles) configured and operated to view emissions in the NIR spectrum. NIR illumination flares generate a significant amount of NIR radiation while limiting the generation of visible radiation, thereby facilitating relatively covert illumination of a target. However, a number of problems have been encountered in the development of suitable NIR emitting illumination compositions for use in such NIR illumination flares. For example, conventional illumination compositions exhibit one or more of insufficient NIR radiation generation during combustion, excessive visible radiation generation during combustion (e.g., a poor ratio of generated NIR radiation to generated visible radiation), insufficient (e.g., low) combustion rate, non-uniform combustion, undesired breakup (also known as "chunking") of the illumination composition during use of the NIR illumination flare, excessive ash (e.g., soot) formation during combustion, deleterious environmental impact, poor aging, and excessive production cost. Achieving an improvement in one of the foregoing properties often results in a decline in at least one other of the properties.

It would be desirable to produce an illumination composition that mitigates at least one of the undesirable properties (e.g., low NIR radiation generation, excessive visible radiation generation, low combustion rate, non-uniform combustion, undesired breakup, excessive ash formation, negative environmental impact, poor aging, excessive production cost, etc.) encountered with conventional NIR emitting illumination compositions without significantly decreasing at least one other of the desirable properties of such illumination compositions.

BRIEF SUMMARY

Embodiments described herein include illumination compositions, illumination flares, and methods of illuminating a target.

For example, in accordance with one embodiment described herein, an illumination composition comprises at least one oxidizer, at least one of a fuel and a binder, and at least one combustion rate modifier. The at least one oxidizer is selected from the group consisting of a potassium-containing oxidizer and a rubidium-containing oxidizer, the at least one oxidizer present in the illumination composition at from about 50 wt % to about 70 wt % and comprising particles each independently having a size within a range of from about 25 μm to about 325 μm.

In additional embodiments, an illumination composition comprises at least one oxidizer, at least one of a fuel and a binder, and at least one metal oxide. The at least one oxidizer is selected from the group consisting of a potassium-containing oxidizer, a rubidium-containing oxidizer, and cesium-containing oxidizer. The at least one metal oxide exhibits a specific surface area of greater than or equal to about 90 $m^2/g$.

In further embodiments, an illumination flare comprises a casing and an illumination composition contained within the casing. The illumination composition comprises at least one oxidizer, at least one of a fuel and a binder, and at least one combustion rate modifier. The at least one oxidizer is selected from the group consisting of a potassium-containing oxidizer, a rubidium-containing oxidizer, and a cesium-containing oxidizer, and comprises particles each independently having a size within a range of from about 25 μm to about 325 μm. The at least one combustion rate modifier is selected from the group consisting of boron and a high surface area metal oxide.

In yet further embodiments, a method of illumining a target comprises deploying a illumination flare comprising a casing and a illumination composition contained within the casing. The illumination composition comprises at least one oxidizer, at least one of a fuel and a binder, and at least one combustion rate modifier. The at least one oxidizer is selected from the group consisting of a potassium-containing oxidizer, a rubidium-containing oxidizer, and a cesium-containing oxidizer, and comprises particles each independently having a size within a range of from about 25 μm to about 325 μm. The at least one combustion rate modifier is selected from the group consisting of boron and a high surface area metal oxide. The illumination composition is combusted to produce near infrared radiation.

BRIEF DESCRIPTION OF THE DRAWING

FIG. 1 is a cross-sectional view of an illumination flare including a candle formed from an illumination composition according to embodiments of the disclosure.

DETAILED DESCRIPTION

Illumination compositions are disclosed, as are related illumination flares and methods of illuminating a target. The illumination compositions may be used as flare compositions of NIR illumination flares. As described in further detail below, an illumination composition of the disclosure includes at least one oxidizer, and at least one of a fuel and a binder. The illumination composition may also include at least one additive, such as at least one combustion rate modifier. The components (e.g., ingredients) of the illumination composition, when ignited and combusted, promote the production of NIR radiation while limiting the production of visible radiation. The illumination compositions of the disclosure may exhibit at least one of lower weight, improved (e.g., faster) combustion rates, cleaner combustion (e.g., less ashing or sooting), increased NIR radiation intensity during combustion, and decreased visible radiation intensity during combustion as compared to conventional illumination flares including conventional illumination compositions.

As used herein, the singular forms "a," "an," and "the" are intended to include the plural forms as well, unless the context clearly indicates otherwise.

As used herein, any relational term, such as "first," "second," "over," "under," "on," "underlying," "upper," "lower," etc., is used for clarity and convenience in understanding the disclosure and accompanying drawings and does not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

An illumination composition of the disclosure may be formed of and include an oxidizer, and at least one of a fuel and a binder. Optionally, the illumination composition may also include at least one additive (e.g., at least one of a combustion rate modifier, a heat producing material, a curative, etc.). The illumination composition may comprise, consist essentially of, or consist of the disclosed components.

The oxidizer may be an oxygen-containing material that contributes to the ignition and combustion of at least one other component (e.g., fuel, binder, combustion rate modifier, etc.) of the illumination composition, and that also contributes to the production of NIR radiation during the combustion. The oxidizer may promote the production of radiation in the NIR spectrum, while limiting the production of radiation in the visible light spectrum. The oxidizer may, for example, comprise at least one oxygen-containing salt of potassium (K), rubidium (Rb), and/or cesium (Cs). By way of non-limiting example, the oxidizer may comprise at least one of potassium nitrate ($KNO_3$), potassium chlorate ($KClO_3$), potassium perchlorate ($KClO_4$), potassium peroxide ($K_2O_2$), rubidium nitrate ($RbNO_3$), rubidium chlorate ($RbClO_3$), rubidium perchlorate ($RbClO_4$), rubidium peroxide ($Rb_2O_2$), cesium nitrate ($CsNO_3$), cesium chlorate ($CsClO_3$), cesium perchlorate ($CsClO_4$), and cesium peroxide ($Cs_2O_2$). The amount of the oxidizer present in the illumination composition may be selected based on the other components of the illumination composition, on the desired emission performance, and on the desired method of forming (e.g., casting, pressing, etc.) the illumination composition into a desired configuration (e.g., shape, density, etc.). By way of non-limiting example, the oxidizer may be present in the illumination composition at from about 40 percent by weight (wt %) to about 85 wt %, such as from about 50 wt % to about 70 wt %. In some embodiments, $KNO_3$ is present in the illumination composition at from about 55 wt % to about 70 wt %.

If a Cs-containing oxidizer is present in the illumination composition, such as in embodiments wherein the illumination composition is formulated for enhanced performance in low temperature conductions (e.g., cold wind conditions), the illumination composition may include less than or equal to about 10 wt % of the Cs-containing oxidizer (e.g., $CsNO_3$, $CsClO_3$, $CsClO_4$, $Cs_2O_2$, etc.), such as less than or equal to about 5 wt % of a Cs-containing oxidizer, less than equal to about 2 wt % of a Cs-containing oxidizer, less than equal to about 1 wt % of a Cs-containing oxidizer, or about 0 wt % of a Cs-containing oxidizer. In some embodiments, the illumination composition includes from about 1 wt % to about 5 wt % of the Cs-containing oxidizer. At least one of a K-containing oxidizer (e.g., $KNO_3$, $KClO_3$, $KClO_4$, $K_2O_2$, etc.) and a Rb-containing oxidizer (e.g., $RbNO_3$, $RbClO_3$, $RbClO_4$, $Rb_2O_2$, etc.) may be present in the illumination composition at from about 30 wt % to about 85 wt %, such as from about 40 wt % to about 70 wt %, or from about 50 wt % to about 70 wt %. By way of non-limiting example, the illumination composition may include less than or equal to about 5 wt % $CsNO_3$, and from about 45 wt % $KNO_3$ to about 65 wt % $KNO_3$. In some embodiments, the illumination composition includes from about 59 wt % $KNO_3$ to about 64 wt % $KNO_3$, and from about 0 wt % $CsNO_3$ to about 5 wt % $CsNO_3$. The use of K-containing oxidizer(s) in the illumination composition may decrease the weight, cost, and ashing (e.g., sooting) of illumination flares relative to conventional illumination flares including conventional illumination compositions having greater amounts of Cs-containing oxidizer(s). In additional embodiments, depending on the other components (e.g., fuel, binder, combustion rate modifier, etc.) of the illumination composition and on the desired properties of the illumination composition (e.g., weight, combustion rate, NIR radiation intensity, etc.), an illumination composition of the disclosure may include greater than about 10 wt % of the Cs-containing oxidizer.

The oxidizer may be present in the illumination composition as a plurality of particles. The oxidizer may have a monomodal particle size distribution, or may have a multimodal (e.g., bimodal, trimodal, etc.) particle size distribution. For example, the oxidizer may have a multimodal particle size distribution including larger particles and smaller particles. The larger particles of the oxidizer may each independently have a particle size within a range of from about 275 micrometers (μm) to about 325 μm, and may be present in the illumination composition at from about 35 wt % to about 55 wt %. The larger particles may be monodisperse, wherein all of the larger particles are of substantially the same size, or may be polydisperse, wherein the larger particles have a range of sizes and are averaged. The smaller particles of the oxidizer may each independently have a particle size within a range of from about 25 μm to about 65 μm (e.g., from about 25 μm to about 35 μm, and/or from about 40 μm to about 65 μm), and may be present in the illumination composition at from about 15 wt % to about 30 wt %. The smaller particles may be monodisperse, wherein all of the smaller particles are of substantially the same size, or may be polydisperse, wherein the smaller particles have a range of sizes and are averaged. In some embodiments, the illumination composition includes about 44 wt % of the larger particles of the oxidizer, and about 20 wt % of the smaller particles of the oxidizer. For example, the illumination composition may include about 44 wt % $KNO_3$ particles each independently having a size within a range of from about 275 μm to about 325 μm, and about 20 wt % $KNO_3$ particles each independently having a size within a range of from about 25 μm to about 35 μm. The larger particles and the smaller particles may be formed of and include the same materials as one another (e.g., the larger particles and the smaller particles may both be formed of and include at least one of a K-containing oxidizer, an Rb-containing oxidizer, and a Cs-containing oxidizer), or the larger particles and the smaller particles may be formed of and include different materials than one another (e.g., the larger particles may be formed of and include at least one of a K-containing oxidizer, an Rb-containing oxidizer, and a Cs-containing oxidizer, and the smaller particles may be formed of and include at least one other of a K-containing oxidizer, an Rb-containing oxidizer, and a Cs-containing oxidizer). As a non-limiting example, at least in embodiments wherein the illumination composition is formulated for enhanced performance in low temperature conductions, the illumination composition may include at least one of large particles of a Cs-containing oxidizer and small particles of a Cs-containing oxidizer in addition to at least one of large particles of a K-containing oxidizer and small particles of a K-containing oxidizer. The illumination composition may, for example, comprise from about 40 wt % to about 45 wt % $KNO_3$ particles each independently having a size within a range of from about 275 μm to about 325 μm, from about 15 wt % to about 20 wt % $KNO_3$ particles each independently having a size within a range of from about 25 μm to about 35 μm, and from about 1 wt % to about 5 wt % $CsNO_3$ particles each independently having a size within a range of from about 40 μm to about 65 μm. In additional embodiments, the oxidizer may have a monomodal particle size distribution including particles each having substantially the same particle size with a range of from about 25 μm to about 325 μm.

The fuel may comprise any combustible material that promotes the generation of NIR radiation while limiting the generation of visible radiation. The fuel may, for example, be a material that produces relatively little soot (e.g., ash) when combusted, which may reduce the amount of visible radiation generated. The fuel may be selected based on the other components of the illumination composition (e.g., the oxidizer, the binder, etc.). Non-limiting examples of suitable fuels include elemental silicon (Si), boron (B), nitrogen-containing materials (e.g., nitrogen-containing compounds containing 3- to 6-membered heterocyclic rings and 1 nitrogen or oxygen atom to 4 nitrogen or oxygen atoms in the ring, such as tetrazole, triazole, triazine, imidazole, oxazole, pyrazole, pyrroline, pyrrolinidene, pyridine, and/or pyrimidine; alkali metal salts of such nitrogen-containing compounds, such as K salts, Rb salts, and/or Cs salts of such nitrogen-containing compounds; bridged polycyclic amines, such as dicyanidiamide, cyanonitriamide, hydrogencyanide, and/or dicyanamide; nitramines; nitrocellulose; nitroguanidine; or combinations thereof), urea, guanidine, azodicarbonamide, short chain alkyls including 1 carbon atom to 8 carbon atoms, or combinations thereof. In some embodiments, the fuel is elemental Si. In additional embodiments, the fuel may function as both a fuel and a binder. The amount of the fuel present in the illumination composition may be selected based on the other components of the illumination composition, on the desired emission performance, and on the desired method of forming the illumination composition into a desired configuration (e.g., shape, density, etc.). By way of non-limiting example, the fuel may be present in the illumination composition at from about 0 wt % to about 20 wt %, such as from about 4 wt % to about 20 wt %, or from about 8 wt % to about 10 wt %. In some embodiments, elemental Si is present in the illumination composition at from about 8 wt % to about 13 wt %.

The fuel may be present in the illumination composition as a plurality of particles. The fuel may have a monomodal particle size distribution, or may have a multimodal (e.g., bimodal, trimodal, etc.) particle size distribution. As a non-limiting example, the particles of the fuel may each independently have a particle size within a range of from about 0.5 μm to about 15 μm. In some embodiments, the particles of the fuel each independently have a particle size within a range of from about 0.5 μm to about 2 μm (e.g., from about 1 μm to about 2 μm). In additional embodiments, the particles of the fuel each independently have a particle size within a range of from about 5 μm to about 15 μm (e.g., from about 7 μm to about 11 μm). The particles of the fuel may be monodisperse, wherein all of the particles are of substantially the same size, or may be polydisperse, wherein the particles have a range of sizes and are averaged.

The illumination composition may include the fuel and the oxidizer in a fuel:oxidizer ratio of less than or equal to about 2.5, such as with a range of from about 1.4 to about 2.0, or from about 1.6 to about 1.8. The fuel:oxidizer ratio may be selected based on the desired emission performance of the illumination composition.

The binder may be any energetic binder or non-energetic binder that promotes the generation of NIR radiation while limiting the generation of visible radiation. The binder may, for example, comprise a material that produces relatively little soot (e.g., ash) when combusted, which may reduce the amount of visible radiation generated. The binder may be selected based on the other components of the illumination composition (e.g., the oxidizer, the fuel, etc.). Non-limiting examples of suitable energetic binders include poly(3-azidomethyl-3-methyloxetane) (poly-AMMO), poly(bis(3,3-azidomethyl)oxetane) (poly-BAMO), poly(3-nitratomethyl-3-methyloxetane) (poly-NIMMO), a random copolymer of poly-(BAMO) and poly-AMMO, glycidyl azide polymer (GAP), polyglycidyl nitrate (PGN), poly(nitraminomethylmethyloxetane) (poly-NAMMO), copoly-BAMMO/NAMMO, copoly-BAMMO/AMMO, nitrocellulose, nitroglycerine, other nitrate esters, or a combinations thereof. Non-limiting examples of suitable non-energetic binders may include a silicone, a triethyleneglycol succinate, gum arabic, gum tragacanth, gum xanthan, gum turpentine, a polyester, a polyether, a polyurethane, a polystyrene, a polyvinyl alcohol, a styrene-butadiene, an epoxy resin, an isobutylene rubber, or a combination thereof. In some embodiments, the binder is a carboxy terminated triethyleneglycol succinate, such as Witco 1780, which is commercially available from Chemtura Corp. (Middlebury, Conn.). In additional embodiments, the binder may function as both a binder and a fuel. The amount of the binder present in the illumination composition may be selected based on the other components of the illumination composition, on the desired emission performance, and on the desired method of forming the illumination composition into a desired configuration (e.g., shape, density, etc.). The binder may, for example, be present in the illumination composition at from about 0 wt % to about 50 wt %, such as from about 1 wt % to about 50 wt %. For example, if it is desired to press the illumination composition into a desired configuration, the binder may be present in the illumination composition at from about 1 wt % to about 10 wt %. As another example, if it is desired to cast the illumination composition into a desired configuration, the binder may be present in the illumination composition at from about 10 wt % to about 50 wt %. In some embodiments, the binder is present in the illumination at from about 15 wt % to about 25 wt %. The binder may be used with a curative, as described below.

The additive may comprise at least one of a combustion rate modifier (e.g., catalyst) and a curative. The type and amount of the additive may depend on the desired properties (e.g., combustion rate, cure rate, ignition sensitivity, etc.) of the illumination composition, as described in further detail below.

The combustion rate modifier, if present, may comprise a material that enhances (e.g., increases) a combustion rate of the illumination composition, and that promotes the generation of NIR radiation while limiting the generation of visible radiation. The combustion rate modifier may produce relatively little soot (e.g., ash) when combusted, which may reduce the amount of visible radiation generated. The combustion rate modifier may be selected based on the other components of the illumination composition (e.g., the oxidizer, the fuel, the binder, etc.). Non-limiting examples of suitable combustion rate modifiers include boron (B) (e.g., amorphous B), metal oxides (e.g., high surface area metal oxides, such as a high surface area iron oxide, a high surface area aluminum oxide, etc.), or combinations thereof. In some embodiments, the combustion rate modifier comprises a B material including from about 85 wt % amorphous B to about 100 wt % amorphous B. The B material may be present in the illumination composition at from about 0.5 wt % to about 20 wt %, such as from about 0.5 wt % to about 10 wt %, or from about 2 wt % to about 5 wt %. In additional embodiments, the combustion rate modifier comprises a high surface area metal oxide. The high surface area metal oxide may exhibit a specific surface area greater than that of metal oxides (e.g., iron oxides) conventionally included in illumination compositions. The high surface area metal oxide may, for example, exhibit a specific surface area of greater than about 8 $m^2/g$ as measured by the Brunauer-Emmett-Teller (BET) technique, such as greater than or equal to about 10 $m^2/g$, greater than or equal to about 20 $m^2/g$, greater than or equal to about 30 $m^2/g$, greater than or equal to about 40 $m^2/g$, greater than or equal to about 50 $m^2/g$, greater than or equal to about 60 $m^2/g$, greater than or equal to about 70 $m^2/g$, greater than or equal to about 80 $m^2/g$, or greater than or equal to about 90 $m^2/g$. In some embodiments, the high surface area metal oxide exhibits a specific surface area of greater than or equal to about 80 $m^2/g$ as measured by the BET technique. In additional embodiments, the high surface area metal oxide exhibits a specific surface area of greater than or equal to about 90 $m^2/g$ as measured by the BET technique (e.g., about 93 $m^2/g$ as measured by the BET technique). As a non-limiting example, the high surface area metal oxide may comprise a high surface area iron oxide, such as that sold under the SICOTRANS® tradename (e.g., SICOTRANS® Red L 2816, SICOTRANS® Red L 2817, SICOTRANS® Red L 2818, SICOTRANS® Red L 2819, SICOTRANS® Yellow L 1915, SICOTRANS® Yellow L 1916, SICOTRANS® Yellow L 1918), which is commercially available from BASF Corp. (Florham Park, N.J.). The high surface area metal oxide may be present in the illumination composition at greater than or equal to about 0.25 wt %, such as from about 0.25 wt % to about 40.0 wt %, from about 0.25 wt % to about 20.0 wt %, from about 0.25 wt % to about 10.0 wt %, from about 0.25 wt % to about 5.0 wt %, from about 0.25 wt % to about 2.0 wt %, from about 0.5 wt % to about 1.5 wt %, or about 1.0 wt %. Amounts of the high surface area metal oxide (e.g., high surface area iron oxide) present in the illumination composition in excess of about 2.0 wt % may function as a filler material for the illumination composition. In some embodiments, the combustion rate modifier comprises from about 0.5 wt % high surface area iron oxide to about 1.0 wt % high surface area iron oxide, and from about 2 wt % amorphous B to about 5 wt % amorphous B. The amount of the combustion rate modifier may be adjusted (e.g., increased or decreased) to achieve one or more desired properties of the illumination composition.

In embodiments where the illumination composition includes a high surface area metal oxide (e.g., alone, or in combination with another combustion rate modifier, such as B), the high surface area metal oxide may enhance one or more desired properties of the illumination composition. For example, the high surface area metal oxide may increase the surface area of the illumination composition that combusts upon ignition, increasing combustion rate and NIR radiation intensity, while limiting the production of visible radiation. In addition, the high surface area metal oxide may facilitate or promote the formation of water insoluble and non-water-reactive soot (i.e., as opposed to the formation of water soluble soot and/or water reactive soot) when the illumination composition is combusted. For example, at least in embodiments wherein the oxidizer of the illumination composition is predominantly a K-containing oxidizer (e.g., a K salt, such as $KNO_3$), the presence of a high surface area metal oxide (e.g., a high surface area iron oxide, such as SICOTRANS® Red L 2816, SICOTRANS® Red L 2817, SICOTRANS® Red L 2818, SICOTRANS® Red L 2819, SICOTRANS® Yellow L 1915, SICOTRANS® Yellow L 1916, and/or SICOTRANS® Yellow L 1918) in the illumination composition may facilitate the formation of soot that is at least partially (e.g., substantially) water insoluble and non-water-reactive when the illumination composition is combusted. Furthermore, the high surface area metal oxide may reduce the pH of the illumination composition and of the ash formed during the combustion of illumination composition relative to many conventional illumination compositions. As a non-limiting example, the ash formed during the combustion of the illumination composition may exhibit a pH of less than or equal to about 14, such as less than or equal to about 13, less than or equal to about 12, or less than or equal to about 11. Accordingly, an illumination composition in accordance with an embodiment of the disclosure may reduce the environmental impact associated with the use thereof in an illumination flare as compared to many conventional illumination compositions.

The curative, if present, may comprise a material that enhances (e.g., increases) a cure rate of the illumination composition, and that promotes the generation of NIR radiation while limiting the generation of visible radiation. The curative may be selected based on the other components of the illumination composition (e.g., the oxidizer, the fuel, the binder, etc.). By way of non-limiting example, the curative may comprise an aliphatic polyisocyanate resin based on hexamethylene diisocyanate (HDI), such as that sold under the DESMODUR® N 100 tradename by Bayer MaterialScience (Pittsburgh, Pa.), or a trifunctional epoxy resin curative (ERL) that reacts with the carboxy functional groups of carboxy terminated triethyleneglycol succinate. In some embodiments, the curative is a Bis-phenyl A-trifunctional epoxy resin curative, such as N,N-diglycidyl-4-glycidyloxyaniline (ERL 510). The curative may be present in the illumination composition at from about 0.1 wt % to about 20 wt %, such as from about 0.1 wt % to about 5 wt %. In some embodiments, the curative is present in the illumination composition at from about 2.5 wt% wt % to about 3.5 wt %.

The illumination composition may also include other additives, such as colorants, processing aids, bonding agents, stabilizers, or ballistic enhancers, in minor amounts, depending on the desired properties of the illumination composition.

The illumination composition may be produced by combining the individual components of the illumination composition by conventional techniques. The illumination composition may exhibit a lower density than conventional illumination compositions. For example, the illumination composition may be up to about 25 percent less dense than many conventional illumination compositions. A candle (e.g., grain, flare composition, payload) formed of and including the illumination composition may be produced by casting, pressing, molding, and/or extruding the illumination composition. Such processes are known in the art and, therefore, are not described in detail herein. In some embodiments, the illumination composition is produced by combining the individual components of the illumination composition by a mixed cast process. By way of non-limiting example, the individual components may be combined to form a slurry, and articles fabricated from the slurry, such as by casting the slurry into a casing or mold, and curing the slurry at a moderately elevated temperature to form the candle. Once cured, the candle can be removed from the casing or mold. The candle may have a relatively high hardness, such as a Shore A hardness of greater than about 65, such as greater than about 80.

Embodiments of the illumination compositions of the disclosure may be used as a drop-in replacement for the candle (e.g., grain, flare composition, payload) of a conventional illumination flare, such as an illumination flare having a 38-millimeter (mm) diameter, a 60-mm diameter, an 81-mm diameter, a 105-mm diameter, a 120-mm diameter, a 155-mm diameter, a 2.75-inch (in) diameter, or a 5.0-in diameter. Non-limiting examples include M278, LUU-19, and handheld signal flares. Thus, the illumination flare may be a "modified" M278, LUU-19, or handheld signal flare in that the candle of a conventional illumination flare is replaced with a candle formed of and including an illumination composition according to an embodiment of the disclosure.

FIG. 1 illustrates an embodiment of a flare 100, such as an illumination flare, that includes a candle 102 formed of and including an illumination composition according to an embodiment of the disclosure. The increased combustion rate of the illumination composition effectuated by one or more of the components (e.g., the combustion rate modifier, such as a high surface area metal oxide) of the illumination composition may facilitate additional volume in and/or a lower weight of the candle 102 as compared to many conventional illumination flare candles. In addition, in embodiments wherein at least a majority (e.g., greater than 50 wt %, such as greater than or equal to about 60 wt %, greater than or equal to about 70 wt %, greater than or equal to about 80 wt %, greater than or equal to about 90 wt %, or greater than or equal to about 95 wt %) of the oxidizer of the illumination composition comprises a non-Cs-containing oxidizer (e.g., a K-containing oxidizer, such as $KNO_3$; and/or a Rb-containing oxider, such as $RbNO_3$), the decreased weight of the illumination composition (i.e., as compared to conventional illumination compositions wherein a Cs-containing oxidizer constitutes at least a majority of the oxidizer) may also facilitate additional volume in and/or less weight of the candle 102. The additional volume can be filled with an inert material for matching ballistic performance, can be filled with at least one active component (e.g., oxidizer, fuel, binder, etc.) to provide greater NIR radiation intensity or combustion time, and/or the decreased weight of the candle 102 can be used to improve at least one of the ballistic performance and handling of the flare 100.

As depicted in FIG. 1, the candle 102 may be contained in a casing 104 of the flare 100. The casing 104 includes a first end 106 from which a first end 108 of the candle 102 is ignited, and a second, opposite end 110 from which a parachute 112 contained within the casing 104 is ejected following deployment of the flare 100. A timer/release mechanism 114 contained within the casing 104 may be used to control the release of the parachute 112. As shown in FIG. 1, the first end 106 of the casing 104 also includes an igniter 116 configured and positioned to ignite the candle 102. The flare 100 may be configured such that the release of the parachute 112 initiates (e.g., by way of an igniter lanyard) the igniter 116, which then ignites the first end 108 of the candle 102.

In use and operation, one or more flares 100 may delivered to a target area and the candle 102 may be ignited and combusted (e.g., burned). The combusting candle 102 may illuminate the target area with high intensity NIR radiation. Thus, the NIR illuminated target area may be better viewed through an NIR-sensitive device, such as NIR-sensitive night vision goggles than a target area illuminated by a conventional illumination flare including a conventional illumination composition. In addition, the relatively low visible radiation output of the combusting candle 102 will cause the flare 100 to be virtually invisible to the unaided eye (e.g., facilitating the use of the flare 100 for covert operations).

The illumination compositions according to embodiments of the disclosure may improve or maintain NIR radiation intensity, visible radiation intensity, NIR radiation to visible radiation ratio, combustion rate, combustion time, combustion uniformity, chunking mitigation, and environmental friendliness (e.g., decreased water solubility, decreased pH) as compared to conventional illumination compositions. The combination of these properties has resulted in a substantial improvement over conventional illumination compositions.

The following examples serve to explain embodiments of the present disclosure in more detail. These examples are not to be construed as being exhaustive or exclusive as to the scope of this disclosure.

EXAMPLES

Example 1

Illumination Compositions

Different illumination compositions in accordance with embodiments of the present disclosure were prepared. Compositions A, B, C, D, and E were prepared. The formulations of the Compositions A, B, C, D, and E are summarized below in Tables 1-5, respectively. Compositions C and D were modified versions of Compositions A and B, respectively, that included small amounts of $CsNO_3$ for enhanced performance in low temperature conditions (e.g., cold wind conditions). Each of the components of Compositions A, B, C, D, and E is commercially available, and may be purchased from commercial sources including, but not limited to, Sigma-Aldrich Corp., Chemtura Corp., BASF Corp., Bayer MaterialScience, and Dow Chemical Company. Each of Compositions A, B, C, D, and E was formulated by combining the components thereof according to conventional techniques for processing pyrotechnic compositions.

TABLE 1

| Composition A Formulation | |
|---|---|
| Material | Wt % |
| $KNO_3$ (about 275 μm to about 325 μm particle size) | 43.00 |
| $KNO_3$ (about 25 μm to about 35 μm particle size) | 20.00 |
| SICOTRANS ® Red L 2817 (high surface area iron oxide) | 1.00 |
| Epoxy resin (ERL 0510) | 3.08 |
| Polymer (Witco 1780) | 20.42 |
| Silicon | 8.00 |
| Boron | 4.50 |

TABLE 2

| Composition B Formulation | |
|---|---|
| Material | Wt % |
| $KNO_3$ (about 275 μm to about 325 μm particle size) | 44.00 |
| $KNO_3$ (about 25 μm to about 35 μm particle size) | 20.00 |
| Iron Oxide (non-high surface area) | 0.50 |
| Magnesium carbonate | 0.12 |
| Epoxy resin (ERL 0510) | 2.90 |
| Polymer (Witco 1780) | 20.00 |
| Silicon | 10.50 |
| Boron | 2.00 |

TABLE 3

| Composition C Formulation | |
|---|---|
| Material | Wt % |
| $KNO_3$ (about 275 μm to about 325 μm particle size) | 42.66 |
| $KNO_3$ (about 25 μm to about 35 μm particle size) | 17.34 |
| $CsNO_3$ (about 40 μm to about 65 μm particle size) | 2.00 |
| SICOTRANS ® Red L 2817 (high surface area iron oxide) | 1.00 |
| Epoxy resin (ERL 0510) | 2.85 |
| Polymer (Witco 1780) | 21.15 |
| Silicon | 8.00 |
| Boron | 5.00 |

TABLE 4

| Composition D Formulation | |
|---|---|
| Material | Wt % |
| $KNO_3$ (about 275 μm to about 325 μm particle size) | 43.80 |
| $KNO_3$ (about 25 μm to about 35 μm particle size) | 15.90 |
| $CsNO_3$ (about 40 μm to about 65 μm particle size) | 4.00 |
| Iron Oxide (non-high surface area) | 0.50 |
| Magnesium carbonate | 0.12 |
| Epoxy resin (ERL 0510) | 2.71 |

TABLE 4-continued

| Composition D Formulation | |
|---|---|
| Material | Wt % |
| Polymer (Witco 1780) | 20.17 |
| Silicon | 10.50 |
| Boron | 2.25 |

TABLE 5

| Composition E Formulation | |
|---|---|
| Material | Wt % |
| $CsNO_3$ (about 40 μm to about 65 μm particle size) | 33.25 |
| $KNO_3$ (about 275 μm to about 325 μm particle size) | 33.25 |
| SICOTRANS ® Red L 2817 (high surface area iron oxide) | 1.00 |
| Epoxy resin (ERL 0510) | 2.55 |
| Polymer (Witco 1780) | 20.00 |
| Silicon | 8.50 |
| Boron | 4.00 |

Example 2

Illumination Composition Performance Data

The performance of a 2.75-inch diameter illumination flare including Composition A (see Example 1) and a 5-inch diameter illumination flare including Composition B (see Example 1) was compared against the performance of a 2.75-inch diameter illumination flare including a Baseline Composition A and the performance of a 5-inch diameter illumination flare including a Baseline Composition B, respectively. The performance data is summarized in Tables 6 and 7 below. The Baseline Composition A included 58.75 wt % $KNO_3$, 5 wt % polymer (Witco 1780), 9.79 wt % $CsNO_3$, 6.85 wt % Si, 1 wt % epoxy resin (ERL 0510), 0.98 wt % iron oxide (non-high surface area), 1.96 wt % boron, and 15.76 wt % hexamine. The Baseline Composition B included 33.5 wt % $CsNO_3$, 33.5 wt % $KNO_3$, 12.5 wt % Si, 0.5 wt % iron oxide (non-high surface area), 29.88 wt % polymer (Witco 1780), and 0.12 wt % $MgCO_3$. The performance of the 2.75-inch diameter and 5-inch diameter illumination flares was tested under T-2 wind tunnel and flight conditions using conventional techniques, which are not described in detail herein.

TABLE 6

| Performance Testing Results (Composition A) 2.75-Inch Diameter (end burner) | | |
|---|---|---|
| Performance Metric | Composition A | Baseline Composition A |
| NIR Intensity (Watts/Sr) | 260-290 | 230-350 |
| Visible Radiation Intensity (Lumens/Sr) | 1200-1350 | 990-1350 |
| Combustion Time (s) | 175-195 | 180-300 |
| Subscale Combustion Rate (in/s) | 0.055-0.060 | 0.057-0.092 |

TABLE 7

| Performance Testing Results (Composition B) 5-Inch Diameter (end burner) | | |
|---|---|---|
| Performance Metric | Composition B | Baseline Composition B |
| NIR Intensity (Watts/Sr) | 550-610 | 450-510 |
| Visible Radiation Intensity (Lumens/Sr) | 1800-2200 | 1400-1900 |
| Combustion Time (s) | 480-500 | 440-500 |
| Subscale Combustion Rate (in/s) | 0.025-0.030 | 0.023-0.030 |

The illumination flares including Compositions A and B exhibited performance testing results similar to or better than those of the illumination flares including the Baseline Compositions A and B, respectively, validating the use of Compositions A and B in illumination flares to sufficiently illuminate a target with NIR radiation.

Example 3

Illumination Composition Ashing Characteristics

The ashing characteristics of illumination flares including Compositions A and E (see Example 1) were compared against the ashing characteristics of illumination flares including the Baseline Composition A (see Example 2). The ashing characteristics data is summarized in Table 8 below. The ashing characteristics of the illumination compositions were analyzed using conventional techniques, which are not described in detail herein.

TABLE 8

| Ashing Characteristics Results 2.75" Diameter (end burner) | | | |
|---|---|---|---|
| | Composition A | Composition E | Baseline Composition A |
| Ashing | Low | Moderate | Low |
| Ash Water Solubility & Reactivity | Non-soluble & Non-reactive | Non-soluble & Non-reactive | Soluble & Reactive |
| Ash pH | 11 | 10.5 | >14 |

The ashing characteristics results indicate that the presence of a high surface area iron oxide in Compositions A and E effectuated the production of a water insoluble and non-water-reactive ash, and also reduced the pH of the ash relative to that of the Baseline Composition A. The ashing characteristics results further indicate that relatively lower amounts of $CsNO_3$ (e.g., as in Composition A) in the illumination composition may result in the production of relatively lower amounts of ash.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the following appended claims and their legal equivalents.

What is claimed is:

1. An illumination composition, comprising:

at least one oxidizer selected from the group consisting of a potassium-containing oxidizer and a rubidium-containing oxidizer, the at least one oxidizer present in the illumination composition at from about 50 percent by weight to about 70 percent by weight and comprising:

larger particles each independently having a particle size within a range of from about 275 μm to about 325 μm, the larger particles present in the illumination composition at from about 35 wt % to about 55 wt %; and smaller particles each independently having a particle size within a range of from about 25 μm to about 35 μm, the smaller particles present in the illumination composition at from about 15 wt % to about 30 wt %;

at least one of a fuel and a binder; and at least one combustion rate modifier.

2. The illumination composition of claim 1, wherein the larger particles and the smaller particles comprise different oxidizers than one another.

3. The illumination composition of claim 1, wherein the at least one oxidizer is $KNO_3$.

4. The illumination composition of claim 1, further comprising at least one cesium-containing oxidizer.

5. The illumination composition of claim 4, wherein the cesium-containing oxidizer is present in the illumination composition at less than or equal to about 5 wt %.

6. The illumination composition of claim 5, wherein the cesium-containing oxidizer comprises $CsNO_3$ particles each independently having a size within a range of from about 40 μm to about 65 μm.

7. The illumination composition of claim 1, wherein the at least one of a fuel and a binder comprises elemental silicon particles present in the illumination composition at from about 4 wt % to about 20 wt %, the elemental silicon particles each independently having a size within a range of from about 5 μm to about 15 μm.

8. The illumination composition of claim 1, wherein the at least one of a fuel and a binder comprises the fuel and the binder, the fuel present in the illumination composition at from about 4 wt % to about 20 wt %, and the binder present in the illumination composition at from about 1 wt % to about 50 wt %.

9. The illumination composition of claim 1, wherein the at least one combustion rate modifier is selected from the group consisting of amorphous boron and a high surface area metal oxide.

10. The illumination composition of claim 1, wherein the at least one combustion rate modifier comprises at least one of a high surface area iron oxide and a high surface area aluminum oxide.

11. The illumination composition of claim 1, wherein the at least one combustion rate modifier comprises amorphous boron and a high surface area iron oxide, the amorphous boron present in the illumination composition at from about 2 wt % to about 5 wt %, and the high surface area iron oxide present in the illumination composition at from about 0.5 wt % to about 1 wt %.

12. An illumination composition, comprising:

at least one oxidizer selected from the group consisting of a potassium-containing oxidizer, a rubidium-containing oxidizer, and a cesium-containing oxidizer and comprising:

larger particles each independently having a particle size within a range of from about 275 μm to about 325 μm, the larger particles present in the illumination composition at from about 35 wt % to about 55 wt %; and smaller particles each independently having a particle size within a range of from about 25 μm to about 35 μm, the smaller particles present in the illumination composition at from about 15 wt % to about 30 wt %;

at least one of a fuel and a binder; and at least one metal oxide exhibiting a specific surface area of greater than or equal to about 90 $m^2/g$.

13. The illumination composition of claim 12, wherein the at least one oxidizer comprises at least one of $CsNO_3$, $CsClO_3$, $CsClO_4$, $Cs_2O_2$, $KNO_3$, $KClO_3$, $KClO_4$, $K_2O_2$, $RbNO_3$, $RbClO_3$, $RbClO_4$, and $Rb_2O_2$.

14. The illumination composition of claim 12, wherein the at least one oxidizer comprises $KNO_3$ and $CsNO_3$, the $KNO_3$ present in the illumination composition at from about 50 wt % to about 70 wt %, and the $CsNO_3$ present in the illumination composition at less than or equal to about 5 wt %.

15. The illumination composition of claim 12, wherein the at least one metal oxide comprises at least one of an iron oxide and an aluminum oxide.

16. The illumination composition of claim 12, wherein the at least one metal oxide comprises an iron oxide exhibiting a specific surface area of greater than or equal to about 93 $m^2/g$.

17. The illumination composition of claim 12, wherein the at least one metal oxide comprises an iron oxide present in the illumination composition at less than or equal to about 0.25 wt %.

18. The illumination composition of claim 12, further comprising a boron material comprising from about 85 wt % amorphous boron to about 100 wt % amorphous boron, the amorphous boron present in the illumination composition at from about 0.5 wt % to about 10 wt %.

19. An illumination flare, comprising:

a casing; and an illumination composition contained within the casing and comprising:

at least one oxidizer selected from the group consisting of a potassium-containing oxidizer and a rubidium-containing oxidizer, the at least one oxidizer present in the illumination composition at from about 50 percent by weight to about 70 percent by weight and comprising:

larger particles each independently having a particle size within a range of from about 275 μm to about 325 μm, the larger particles present in the illumination composition at from about 35 wt % to about 55 wt %; and smaller particles each independently having a particle size within a range of from about 25 μm to about 35 μm, the smaller particles present in the illumination composition at from about 15 wt % to about 30 wt %;

at least one of a fuel and a binder; and at least one combustion rate modifier.

20. The illumination flare of claim 19, wherein the at least one oxidizer comprises the potassium-containing oxidizer, the potassium-containing oxidizer present in the illumination composition at from about 45 wt % to about 65 wt %.

21. The illumination flare of claim 20, further comprising at least one cesium-containing oxidizer, the cesium-containing oxidizer present in the illumination composition at from about 1 wt % to about 5 wt %.

22. The illumination flare of claim 19, wherein the at least one combustion rate modifier comprises a high surface area metal oxide, the high surface area metal oxide present in the illumination composition at from about 0.25 wt % to about 2.0 wt %.

23. The illumination flare of claim 19, wherein the at least one of a fuel and a binder comprises elemental silicon, a ratio of the elemental silicon to the at least one oxidizer within a range of from about 1.4 to about 2.0.

24. A method of illumining a target, comprising:

deploying an illumination flare comprising a casing and an illumination composition contained within the casing, the illumination composition comprising:

at least one oxidizer selected from the group consisting of a potassium-containing oxidizer and a rubidium-containing oxidizer, the at least one oxidizer present in the illumination composition at from about 50 percent by weight to about 70 percent by weight and comprising:

larger particles each independently having a particle size within a range of from about 275 μm to about 325 μm, the larger particles present in the illumination composition at from about 35 wt % to about 55 wt %; and smaller particles each independently having a particle size within a range of from about 25 μm to about 35 μm, the smaller particles present in the illumination composition at from about 15 wt % to about 30 wt %;

at least one of a fuel and a binder; and at least one combustion rate modifier; and combusting the illumination composition to produce near infrared radiation.

* * * * *